US011097434B2

(12) United States Patent
Hooper et al.

(10) Patent No.: US 11,097,434 B2
(45) Date of Patent: Aug. 24, 2021

(54) UTILITY KNIFE

(71) Applicants: Mark Gordon Hooper, Wilson, NC (US); Rodney Miller, Wilson, NC (US); David Christopherson, Raleigh, NC (US)

(72) Inventors: Mark Gordon Hooper, Wilson, NC (US); Rodney Miller, Wilson, NC (US); David Christopherson, Raleigh, NC (US)

( * ) Notice: Subject to any disclaimer, the term of this patent is extended or adjusted under 35 U.S.C. 154(b) by 66 days.

(21) Appl. No.: 16/229,449

(22) Filed: Dec. 21, 2018

(65) Prior Publication Data

US 2019/0193288 A1 Jun. 27, 2019

Related U.S. Application Data

(60) Provisional application No. 62/608,871, filed on Dec. 21, 2017.

(51) Int. Cl.

| | |
|---|---|
| ***B26B 1/00*** | (2006.01) |
| ***B26B 5/00*** | (2006.01) |
| ***B26B 1/10*** | (2006.01) |
| ***B26B 29/02*** | (2006.01) |
| *B26B 1/04* | (2006.01) |
| *B26B 3/08* | (2006.01) |

(52) U.S. Cl.

CPC ..... *B26B 1/10* (2013.01); *B26B 5/003* (2013.01); *B26B 5/005* (2013.01); *B26B 29/02* (2013.01); *B26B 1/042* (2013.01); *B26B 3/08* (2013.01)

(58) Field of Classification Search

CPC ..... B26B 1/042; B26B 1/10; B26B 29/02; B26B 3/08; B26B 5/003; B26B 5/005; B26B 1/00; B26B 1/02; B26B 1/06; B26B 1/08; B26B 5/001; B26B 5/006

USPC ... 30/158, 159, 160, 161, 307, 319, 164, 95, 30/365, 114, 2, 151, 162, 286, 289, 292, 30/293, 154–156

See application file for complete search history.

(56) References Cited

U.S. PATENT DOCUMENTS

| | | | | |
|---|---|---|---|---|
| 1,820,014 A | | 8/1931 | Fenton et al. | |
| 1,858,170 A | | 5/1932 | Edward et al. | |
| 2,260,223 A | * | 10/1941 | Harper | B26F 1/36 83/468.93 |
| 2,602,221 A | * | 7/1952 | Ewing | B26B 21/50 30/36 |
| 2,722,782 A | * | 11/1955 | Metz | B24B 3/58 451/231 |
| 3,034,565 A | * | 5/1962 | Hillix | B23K 9/035 72/385 |

(Continued)

FOREIGN PATENT DOCUMENTS

CN 101248951 A * 8/2008

*Primary Examiner* — Jason Daniel Prone

(74) *Attorney, Agent, or Firm* — Dunlap Bennett & Ludwig, PLLC; Brendan E. Squire

(57) ABSTRACT

An ergonomically designed, auto-retracting utility knife that can safely remain in the user's hand while performing non cutting tasks. This invention allows a person to continue with the jobs they were performing by having the ability to use both hands and not having to set the utility knife down between manual tasks, thus saving time and increasing efficiency. An auto-retracting blade decreases the risk lacerations and other hand/wrist injuries to the user and others during routine use of the knife.

10 Claims, 4 Drawing Sheets

(56) References Cited

U.S. PATENT DOCUMENTS 3,374,814 A * 3/1968 Kaufmann ..... B23D 49/165 83/758
3,506,102 A * 4/1970 Mathison et al. ..... G07F 17/24 194/290
3,641,667 A * 2/1972 Leopoldi ..... B26B 5/005 30/2
3,981,526 A 9/1976 Lundqvist
4,683,656 A * 8/1987 Peyrot ..... B26B 5/003 30/151
4,703,561 A 11/1987 Parisek
4,713,885 A * 12/1987 Keklak ..... B26B 5/003 30/162
4,757,612 A * 7/1988 Peyrot ..... B26B 29/02 30/151
4,769,912 A * 9/1988 Davis ..... B26B 1/08 30/161
4,989,320 A 2/1991 Borkott et al.
5,103,564 A 4/1992 MacDonald
5,299,355 A * 4/1994 Boda ..... B26B 5/003 30/162
5,303,474 A * 4/1994 Keklak ..... B26B 5/003 30/125
5,426,855 A * 6/1995 Keklak ..... B26B 5/003 30/162
5,476,474 A * 12/1995 Davis ..... A61B 5/150022 606/182
5,495,670 A * 3/1996 Quinn ..... B26B 5/001 30/162
5,568,243 A * 10/1996 Durfee ..... G03G 15/168 15/256.51
5,711,077 A * 1/1998 Schulz ..... B26B 25/005 30/160
5,890,294 A * 4/1999 Keklak ..... B26B 5/001 30/161
6,122,828 A * 9/2000 Asterino, Jr. ..... B26B 29/02 30/151
6,148,520 A * 11/2000 Berns ..... B26B 5/003 30/162
6,553,673 B2 * 4/2003 Peyrot ..... B26B 5/003 30/162
6,643,936 B2 * 11/2003 Carlson ..... B26B 25/005 30/162
D484,769 S 1/2004 Cheung
6,785,966 B2 * 9/2004 Berns ..... B26B 5/003 30/112
6,813,833 B2 * 11/2004 Saunders ..... B26B 5/003 30/2
6,857,192 B1 * 2/2005 Summers ..... B26B 5/001 30/162
7,051,443 B2 * 5/2006 Mueller ..... B26B 29/02 30/286
7,322,110 B2 * 1/2008 Hernandez ..... B26B 5/001 30/162
D602,757 S * 10/2009 Kishida ..... D8/99
7,765,701 B2 * 8/2010 Okada ..... B26B 5/003 30/162
8,056,241 B2 * 11/2011 Davis ..... B26B 5/003 30/162
8,065,803 B2 * 11/2011 Austin ..... B26B 5/003 30/151
8,122,605 B2 * 2/2012 Votolato ..... B26B 5/003 30/2
8,220,160 B2 * 7/2012 Davis ..... B26B 29/02 30/162
8,307,556 B2 * 11/2012 Davis ..... B26B 5/003 30/162
8,353,109 B2 * 1/2013 Rohrbach ..... B26B 5/003 30/162
8,707,565 B2 * 4/2014 Muccino ..... B26B 5/001 30/125
8,707,566 B2 * 4/2014 Rohrbach ..... B26B 5/001 30/162
8,769,826 B2 * 7/2014 Wu ..... B26B 5/003 30/125
8,776,380 B1 * 7/2014 Quimby ..... B26B 5/003 30/155
8,782,909 B1 7/2014 Davis et al.
8,931,180 B2 * 1/2015 Davis ..... B26B 5/003 30/162
9,358,692 B2 * 6/2016 Schekalla ..... B26B 5/003
9,579,808 B2 * 2/2017 Scimone ..... B26B 5/003
9,650,065 B2 * 5/2017 Davis ..... B26B 5/003
9,925,674 B2 * 3/2018 Scimone ..... B26B 5/003
9,956,695 B2 * 5/2018 Chung ..... B26B 5/00
10,112,312 B2 * 10/2018 Schekalla ..... B26B 5/003
10,124,495 B2 * 11/2018 Gallegos ..... B26B 5/001
10,137,588 B1 * 11/2018 Davis ..... B26B 29/02
10,245,736 B2 * 4/2019 Huang ..... B26B 5/003
10,279,491 B2 * 5/2019 Scimone ..... B26B 1/10
10,300,615 B2 * 5/2019 Votolato ..... B26B 3/06
10,583,572 B2 * 3/2020 Herlitz ..... B26B 5/001
10,913,168 B1 * 2/2021 Salvitti ..... B26B 1/10
2004/0216309 A1 11/2004 Mueller
2004/0237312 A1 * 12/2004 Hernandez ..... B26B 5/003 30/162
2005/0044726 A1 * 3/2005 Summers ..... B26B 5/001 30/294
2005/0193568 A1 * 9/2005 Peyrot ..... B26B 5/001 30/162
2009/0106983 A1 * 4/2009 Berns ..... B26B 5/003 30/162
2010/0199504 A1 8/2010 Caldwell et al.
2010/0251552 A1 10/2010 Gazcon et al.
2011/0119925 A1 * 5/2011 Rohrbach ..... B26B 5/003 30/158
2011/0119927 A1 * 5/2011 Mueller ..... B26B 5/001 30/162
2012/0192434 A1 * 8/2012 Syrjala ..... B26B 1/08 30/162
2013/0061477 A1 * 3/2013 Lutgen ..... B26B 5/003 30/158
2014/0208594 A1 * 7/2014 Scimone ..... B67B 7/30 30/2
2014/0366385 A1 * 12/2014 Herlitz ..... B26B 5/001 30/162
2015/0202784 A1 7/2015 Ranfelt
2020/0023528 A1 * 1/2020 Rohrbach ..... B26B 5/001
2020/0338767 A1 * 10/2020 Rohrbach ..... B26B 5/003

* cited by examiner

UTILITY KNIFE

CROSS-REFERENCE TO RELATED APPLICATION

This application claims the benefit of priority of U.S. provisional application No. 62/608,871, filed Dec. 21, 2017, the contents of which are herein incorporated by reference.

BACKGROUND OF THE INVENTION

The present invention relates to utility knives, and more particularly utility knives with a retractable cutting blade.

Common utility knives require the user to put down the knife in order to perform subsequent tasks especially when you need the use of both hands. The common utility knife, or box cutter, can become lost because it is often set down frequently to perform other tasks after utilizing the box cutter, such as stocking shelves with a product carried in the box. Also, because the knife must be put down each time the user needs the use of both hands, valuable time is wasted in performing tasks. The box cutter also may slip or accidentally be dropped with its exposed blade, thereby posing a potential hazard of injury to the user or others.

Common utility knives have many flaws. In particular, most do not have auto-retracting blade, which means that when the user has completed the cutting task, the dangerous razor blade remains exposed. Additionally, the common utility knife must be set down repetitively or stored in the users pocket or work-belt so the user must ensure, every time, that the blade is fully retracted or it may cause injury to others or themselves. The repetitive action of having to set down the knife adds additional wasted time to complete the overall tasks performed.

As can be seen, there is a need for an improved utility knife that addresses these deficiencies.

SUMMARY OF THE INVENTION

In one aspect of the present invention an ergonomic utility knife is disclosed. The knife includes an elongate housing having a slotted opening defined along a cutting face of the elongate housing. A handle has an opening defined through a lateral face of the elongate housing. The opening is configured to receive one or more digits of a user's hand. A blade holder is retractably carried within the housing. A trigger is configured to be operated by a thumb of the user when the utility knife is held in a user's hand. The trigger is operable to urge the blade holder towards the slotted opening to a cutting position.

Preferably, a biasing means is provided to move the blade holder away from the slotted opening when the trigger is released in order to return the blade holder to a stowed position. The biasing means may be a spring.

In some embodiments, the cutting face of the elongate housing is arcuate. An outer surface of the handle, opposite the cutting face, has a curvature that is dimensioned to rest in a palm of the user's hand when held by the one or more digits of the user's hand.

In other embodiments, at least one lobe extends from an end of the cutting face. An indentation may be formed in in the housing subjacent to the lobe, between the cutting face and the handle.

In yet other embodiments, the trigger is pivotally disposed within the housing. A first end of the trigger protrudes from a trigger opening in the housing. A second end of the trigger urges against the blade carrier when the trigger is depressed. The blade holder may also be pivotally disposed within the housing.

In yet other embodiments, the utility knife includes a blade carried by the blade holder.

These and other features, aspects and advantages of the present invention will become better understood with reference to the following drawings, description and claims.

DETAILED DESCRIPTION OF THE INVENTION

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Broadly, embodiments of the present invention provide a utility knife with an ergonomic design and auto-retracting blade that allow the utility knife to be carried in the user's hand (right or left) while the user continues to perform other work tasks. The user can also safely perform other tasks such as; grasp items, type, write, use a cell phone or tablet device, tie, twist, drink/eat, while the knife remains on the users hand, ready for use. The auto-retractable blade remains safely retracted and unexposed until the user depresses the trigger button to activate the blade.

Figure 1:
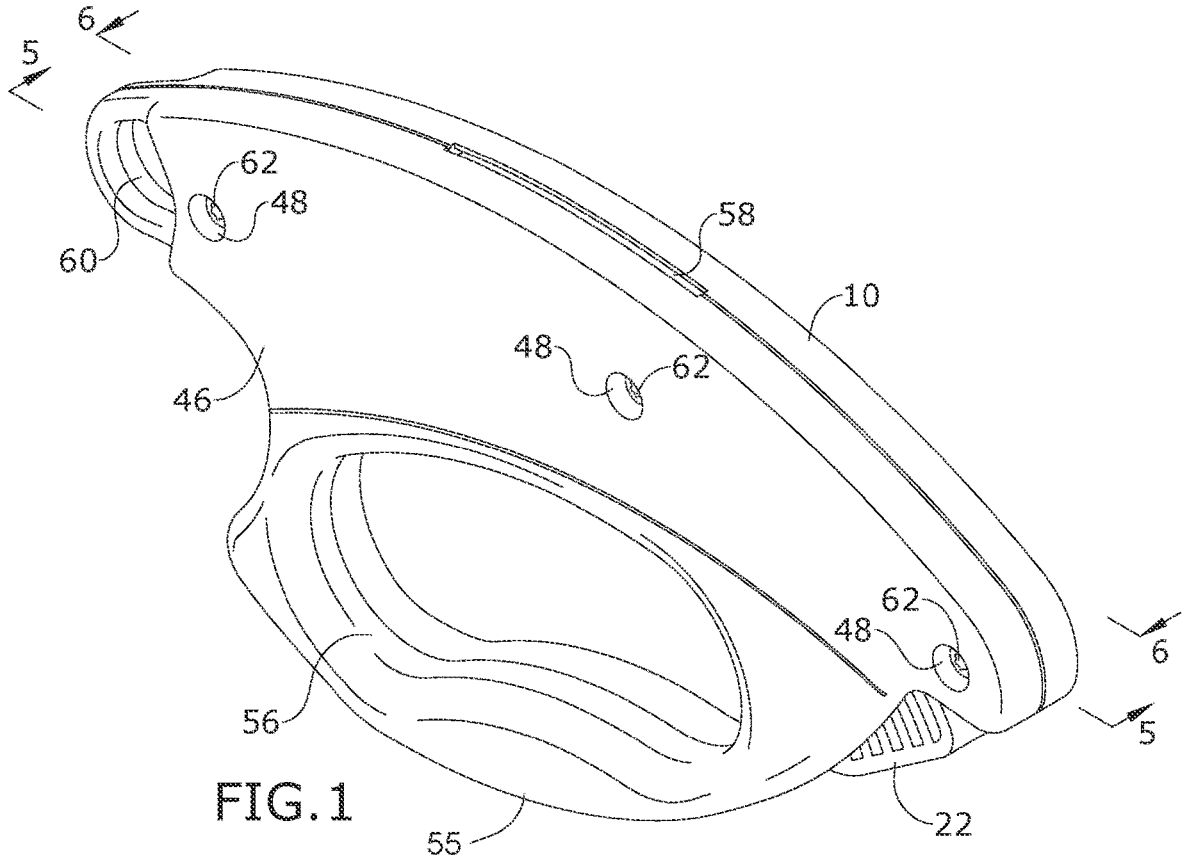
FIG. 1 is a perspective view of the utility knife.
Figure 2:
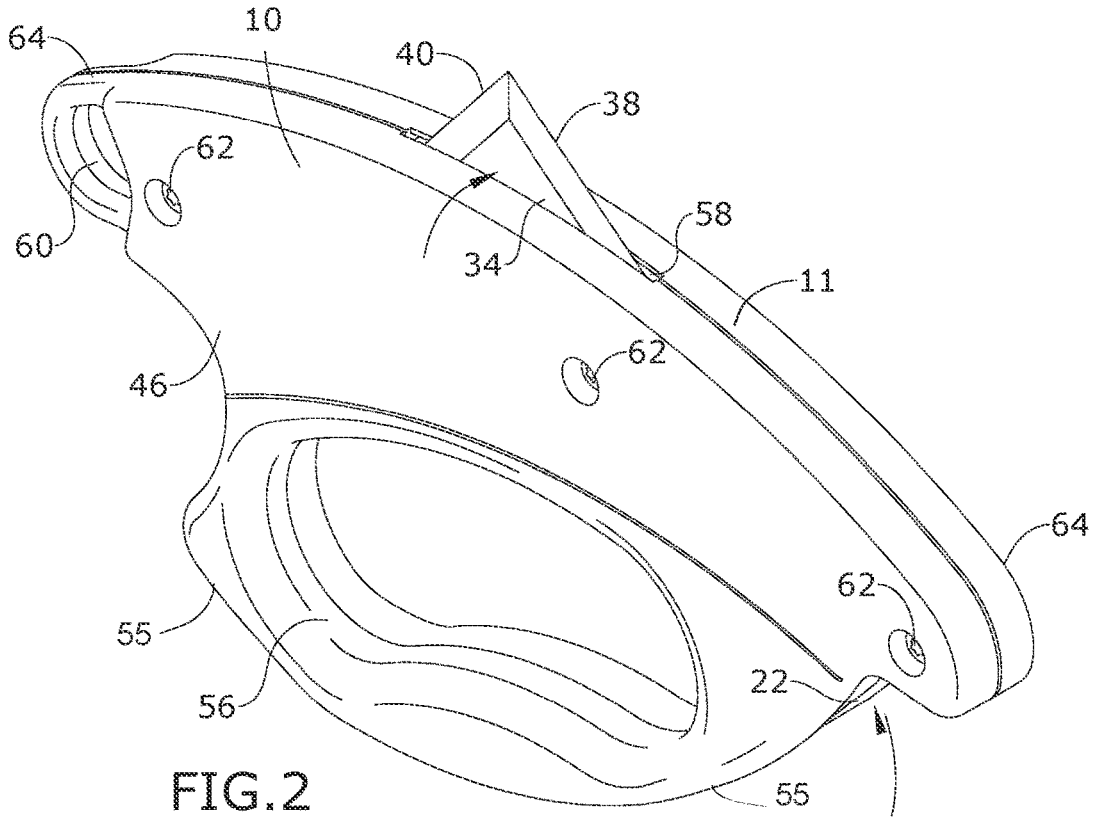
FIG. 2 is a perspective view of the utility knife, showing the extension of blade 34 when trigger 22 is pushed.
Figure 3:
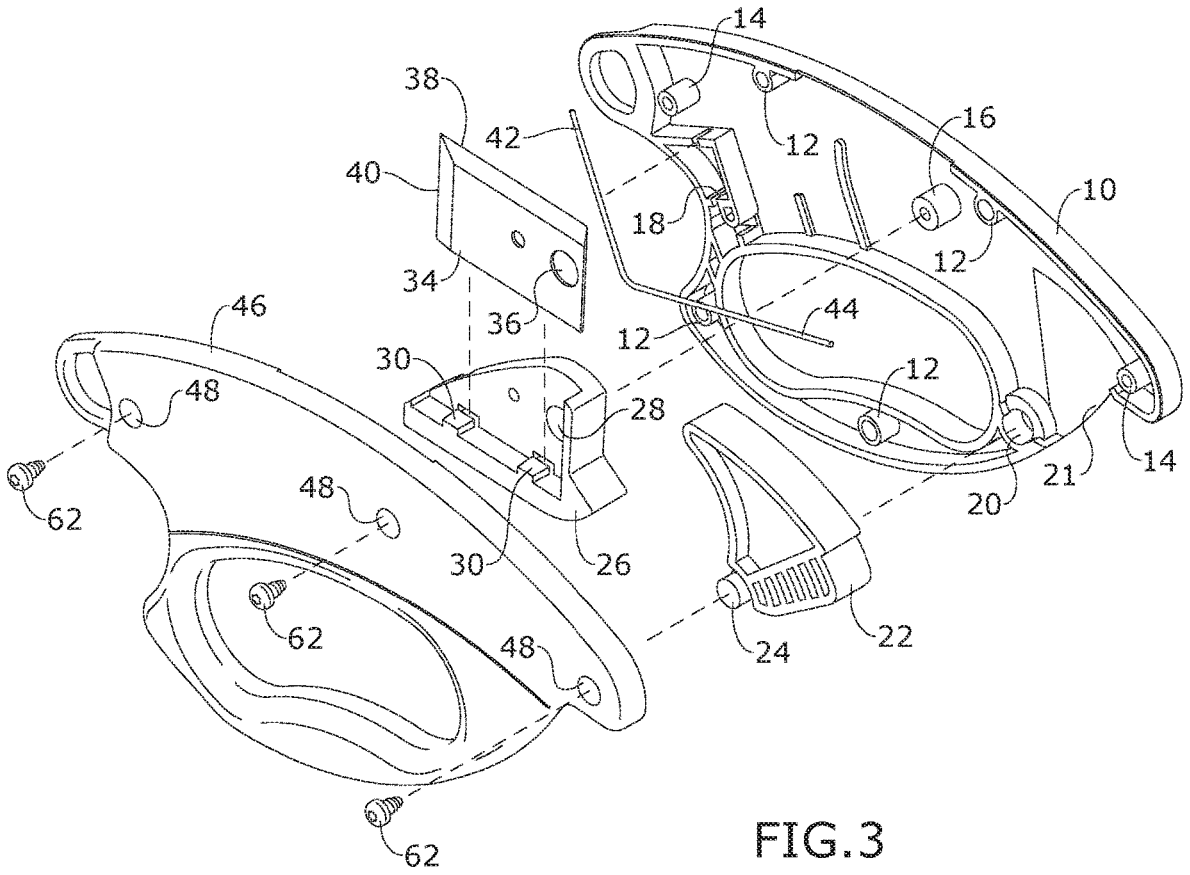
FIG. 3 is an front perspective exploded view of the utility knife.
Figure 4:
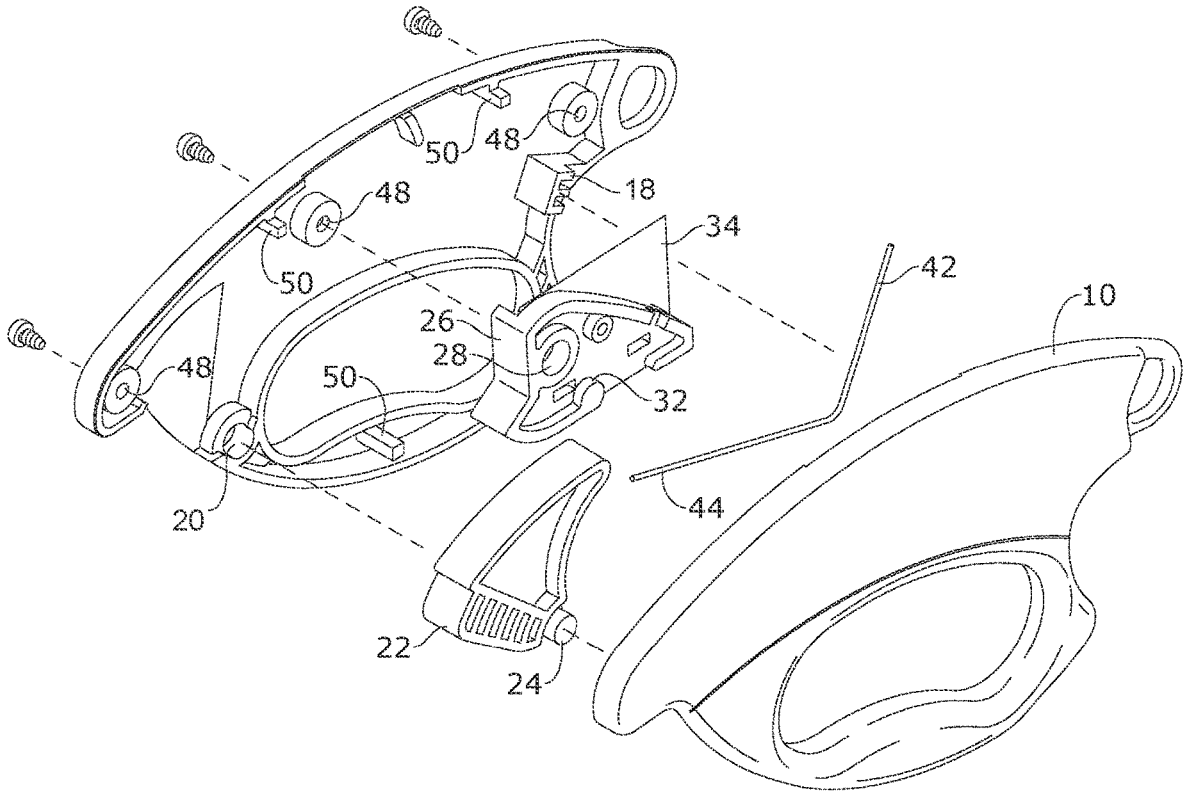
FIG. 4 is an rear perspective exploded view of the utility knife.
Figure 5:
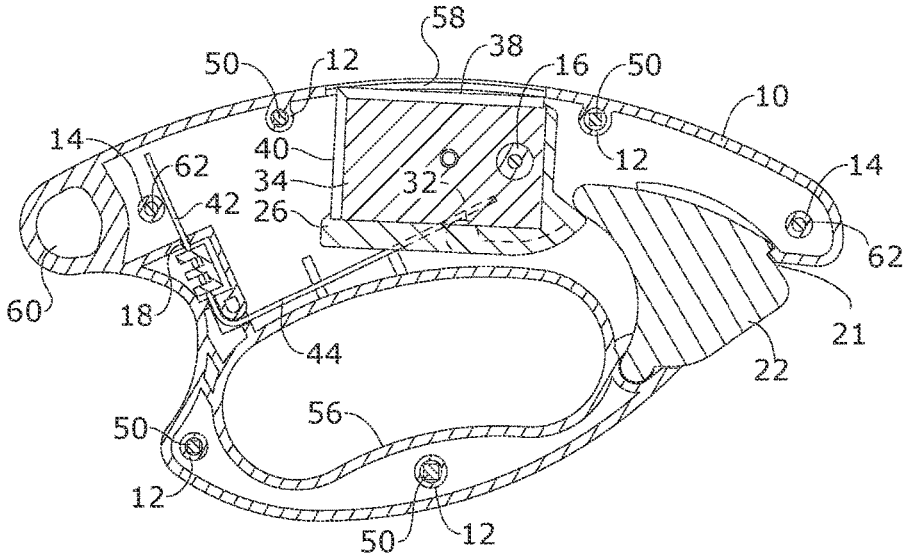
FIG. 5 is a section view of the utility knife, taken along line 5-5 in FIG. 1.
Figure 6:
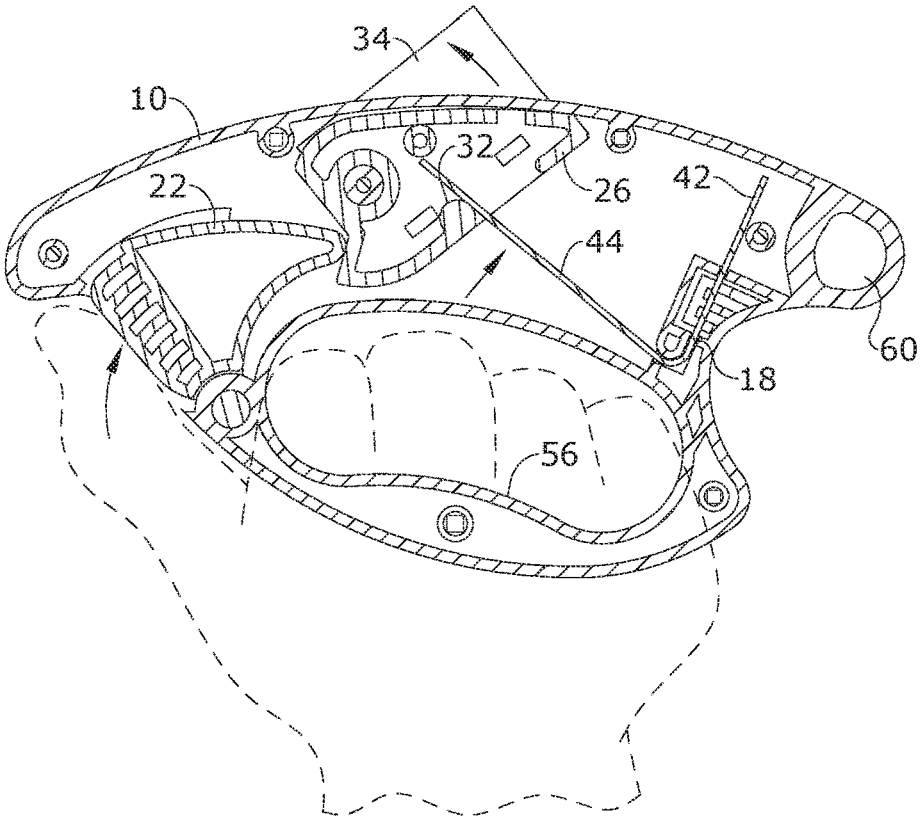
FIG. 6 is a section view of the utility knife, taken along line 6-6 in FIG. 1 illustrating the movement of blade 34, holder 26, and spring leg 44 when trigger 22 is depressed.
Figure 7:
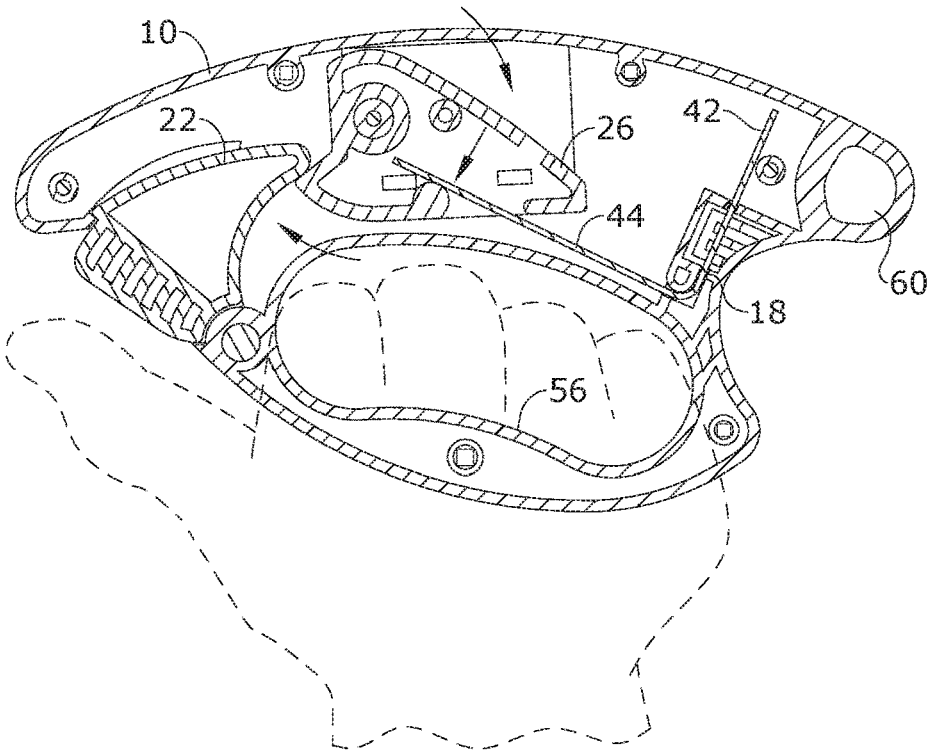
FIG. 7 is a section view of the utility knife, illustrating the automatic retracting of blade 34 when the trigger 22 is released.

As seen in reference to the drawings of FIGS. 1-7, a utility knife, according to aspects of the present invention includes an elongate housing 10 having a slotted opening 58 defined along a cutting face 11 of the elongate housing 10. A handle opening 56 is defined through a lateral face 46 of the elongate housing 10. The handle opening 56 is configured to receive one or more digits of a user's hand. A blade holder 26 is retractably carried within the housing 10. The blade holder 26 is configured to retain a replaceable utility knife blade 34, which may be carried by one or more blade grips 30. The knife blade 34 may be configured with a first cutting edge 38 and a second cutting edge 40 so that the utility knife may be operated for bi-directional cutting.

The utility knife also includes a trigger 22 that is configured to be operated by a thumb of the user when the utility knife is held in a user's hand. The trigger 22 is operable to urge the blade holder 26 towards the slotted opening 58 to a cutting position. A first end of the trigger 22 protrudes from a trigger opening 21 in the housing 10 and a second end of the trigger 22 is configured to urge against the blade holder 26. In some embodiments, the trigger 22 is pivotally disposed on a pivot 24 and pivot slot 20 carried within the housing 10. A trigger latch or a blade carrier latch may be included to easily lock the blade 34 in either the exposed or retracted position if there was a need to keep the blade in one position for an extended period of time. The trigger latch would also allow for bi-directional cutting without a need for the user to maintain constant pressure on the trigger 22.

A biasing means may be provided to automatically move the blade holder 26 away from the slotted opening 58 when the trigger 22 is released to return the blade holder 26 to a stowed position. In the stowed position, the blade 34 carried by the blade holder 26 is retracted within the housing 10 so that a cutting edge of the blade 34 is not exposed. The biasing means may include a spring or other resilient material. In the non-limiting example shown the spring may be an L shaped spring having a first end 42 urged in abutment with a retaining slot 18 defined in an interior of the housing 10 and a second end 44 that is retained within a slot and retainer 32 of the blade carrier 26.

Preferably, the cutting face 11 of the elongate housing 10 is arcuate, so that the cutting face 11 may be operated against a surface to be cut by swiping the blade 34 protruding through the cutting face 11 across the surface to be cut. An outer surface of the handle, opposite the cutting face, may also have an ergonomic curvature 55. The ergonomic curvature 55 provides a palm rest 55 that is dimensioned to rest the outer surface of the handle in a palm of the user's hand when the utility knife is held by the one or more digits of the user's hand.

At least one lobe 64 may extend from an end of the cutting face 11. An indentation in the housing 10 subjacent to the lobe 64 provides a protective barrier between the utility knife handle and the surface to be cut by the knife. The trigger 22 may be pivotally disposed within the housing 10 so that a first end of the trigger 22 protrudes from a trigger opening 21 in the housing 10.

The blade holder 26 may be pivotally disposed within the housing 10. A second end of the trigger 22 may be urged against the blade holder 26 so that upon activation of the trigger 22 the blade holder 26 is rotated about its pivot and the blade extends through the slotted opening 58 in the cutting face 11. A hole 38 in the blade holder 26 and a corresponding hole 36 in the blade 34 may be received on a post 16 and pivotally retained on the post 16 by a fastener 62, such as a pin, bolt, or screw.

An aperture 60 may be defined in at least one of the lobes 64 to permit hanging the utility knife, such as in a storage area, a tool belt, a tether, and the like.

The elongate housing 10 may be made of any suitable material, such as metal, or a polyurethane plastic (ABS). The elongate housing 10 may be formed in joinable shell segments to define an interior cavity for receiving the blade carrier 26 and blade 34. One or more fasteners 62, such as a screw, may be received through a screw hole 48 to secure the shell segments to one or posts 14 within the housing. Guide pins 50 may also be provided to facilitate alignment of the shell segments by reception within a receiver 12 defined in an opposite shell segment.

To use the utility knife of the present invention a person grasps it in their dominant hand or the hand they would typically do manual their tasks. The utility knife is grasped so that the trigger 22 is to be on the same side as the thumb of that person's hand. The user may place their 2nd, 3rd, 4th and 5th fingers in the finger opening. Alternatively, the user may place their 2nd, 3rd, 4th fingers in the opening and their 5th finger may wrap and stabilize against the external ergonomic edge. The user may also place their 2nd and 3rd fingers in the opening and wrap their 4th and 5th finger around the external ergonomic edge. The number of fingers to put in the opening depends on the size of the hand and what feels the most comfortable to that individual for a particular cutting task.

The user may then depress the trigger 22 with their thumb to extend the blade so as to expose the blade. When necessary, the user would release the trigger 22 to automatically permit the blade to return to its retracted position so that the blade is unexposed. The ergonomic shape permits the user to retain the utility knife in their hand and pick up items, grasp, type, lift, push with that same hand and assist their other hand with tasks, as needed, without having to take it off your hand.

The present invention allows a person to continue with the jobs they were performing by having the ability to use both hands and not having to set it down between manual tasks, thus saving time and increasing efficiency. The knife won't get lost or misplaced because doesn't need to put it down as frequently. The auto-retracting blade will decrease lacerations and other hand/wrist injuries to the user and others.

It should be understood, of course, that the foregoing relates to exemplary embodiments of the invention and that modifications may be made without departing from the spirit and scope of the invention as set forth in the following claims.

What is claimed is:

1. A utility knife, comprising:

an elongate housing having a slotted opening defined in a cutting face of the elongate housing;

a handle opening defined through a lateral face of the elongate housing, the handle opening configured to receive one or more digits of a user's hand;

a blade holder retractably carried on a pivot disposed within the elongate housing for rotation of the blade holder to urge a blade, when carried by the blade holder, through the slotted opening thereby defining a cutting position of the blade holder; and a trigger pivotally connected to the elongate housing and configured to be operated by a thumb of the user when the utility knife is held in a user's hand, the trigger pivotally operable to urge the blade holder towards the slotted opening to the cutting position.

2. The utility knife of claim 1, further comprising:

a biasing means in the elongate housing to move the blade holder away from the slotted opening when the trigger is released to return the blade holder to a stowed position.

3. The utility knife of claim 2, wherein the biasing means, comprises a spring having a first end urged in abutment with a retaining slot defined in an interior of the elongate housing and a second end that is retained within a retaining slot of the blade holder.

4. The utility knife of claim 1, wherein the cutting face of the elongate housing is arcuate.

5. The utility knife of claim 1, wherein an outer surface of a portion of the elongate housing defining the handle opening, opposite the cutting face, has an ergonomic curvature to rest in a palm of the user's hand when held by the one or more digits of the user's hand.

6. The utility knife of claim 5, the elongate housing further comprising:

at least one lobe extending from an end of the cutting face.

7. The utility knife of claim 6, further comprising:

an indentation in the elongate housing adjacent to the at least one lobe.

8. The utility knife of claim 1, wherein the trigger is pivotally disposed on a pivot pin within the elongate housing and a first end of the trigger protrudes from a trigger opening in the elongate housing and a second end of the trigger urges against the blade holder.

9. The utility knife of claim 1, further comprising:

a blade carried by the blade holder.

10. A utility knife, comprising:

an elongate housing having a slotted opening defined in a cutting face generally parallel-with a longitudinal length of the elongate housing, a palm rest opposed to the cutting face;

a handle opening generally aligned with the cutting face of the elongate housing, the handle opening defined through a lateral face of the elongate housing and at least partially defined by the palm rest, the handle opening configured to receive one or more digits of a user's hand;

a blade holder retractably carried on a pivot disposed within the elongate housing for rotation of the blade holder about the pivot configured to urge a blade, when carried by the blade holder, through the slotted opening thereby defining a cutting position of the blade holder; and a trigger pivotally connected to the elongate housing and configured to be operated by a thumb of the user when the utility knife is held in a user's hand, the trigger pivotally operable to rotationally urge the blade holder towards the slotted opening to the cutting position.

* * * * *